US011001280B2

(12) United States Patent
Hertel et al.

(10) Patent No.: US 11,001,280 B2
(45) Date of Patent: May 11, 2021

(54) UNIVERSAL TRACK DERAILER ASSEMBLY

(71) Applicant: Western-Cullen-Hayes, Inc., Chicago, IL (US)

(72) Inventors: Kevin D. Hertel, Liberty, IN (US); Austin C. Hertel, Liberty, IN (US)

(73) Assignee: Western-Cullen-Hayes, Inc.

( * ) Notice: Subject to any disclaimer, the term of this patent is extended or adjusted under 35 U.S.C. 154(b) by 248 days.

(21) Appl. No.: 16/131,421

(22) Filed: Sep. 14, 2018

(65) Prior Publication Data

US 2019/0084598 A1 Mar. 21, 2019

Related U.S. Application Data

(60) Provisional application No. 62/559,248, filed on Sep. 15, 2017.

(51) Int. Cl.
*B61K 5/06* (2006.01)

(52) U.S. Cl.
CPC ..... *B61K 5/06* (2013.01)

(58) Field of Classification Search
CPC ..... B61K 5/00; B61K 5/04; B61K 5/06
See application file for complete search history.

(56) References Cited

U.S. PATENT DOCUMENTS

| | | | | |
|---|---|---|---|---|
| 2,829,246 | A * | 4/1958 | Hayes | B61K 5/06 246/163 |
| 3,517,186 | A * | 6/1970 | Hayes | B61K 5/06 246/163 |
| 6,105,906 | A | 8/2000 | Pease et al. | |
| 6,202,564 | B1 * | 3/2001 | Hart | B61K 5/06 104/261 |
| 7,549,611 | B2 | 6/2009 | Hertel | |
| 7,909,293 | B2 | 3/2011 | Pease | |
| 8,262,033 | B2 | 9/2012 | Pease | |

* cited by examiner

*Primary Examiner* — Robert J McCarry, Jr.
(74) *Attorney, Agent, or Firm* — Banner & Witcoff, Ltd.

(57) ABSTRACT

A rail track derailer is comprised of a box assembly which includes a pair of parallel, spaced guide plates supported vertically on a horizontal base mounting plate configured for attachment on the gage of a rail to the top sides of a pair of spaced rail ties. The spaced guide plates may be transversely locked to the gage side of a rail. A pivotal arm is slidably attached between the guide plates. The arm includes a derailer shoe along the top of a rail. An arrangement of guide surfaces and followers that connect the box assembly and arm effect positioning of the shoe on and off the rail. The mounting plate may be attached to ties by spikes and to concrete or steel ties by plates on the underside of such toes bolted to the box assembly mounting plate.

6 Claims, 7 Drawing Sheets

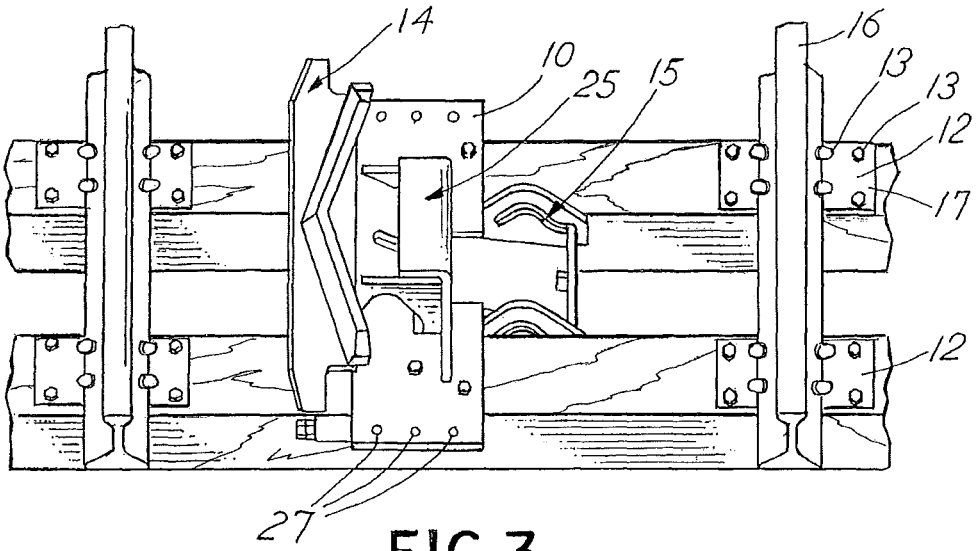
FIG. 3
FIG. 1
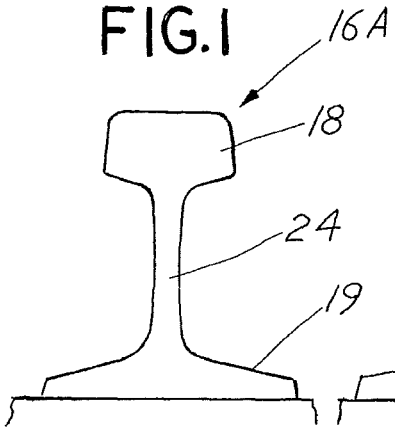
FIG. 2
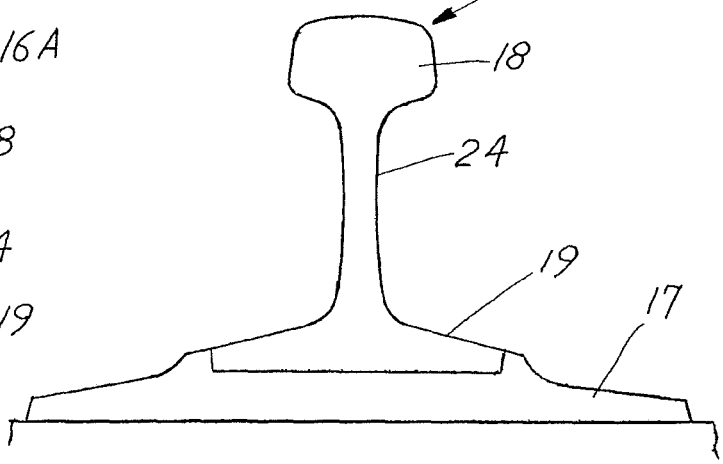

FIG. 5
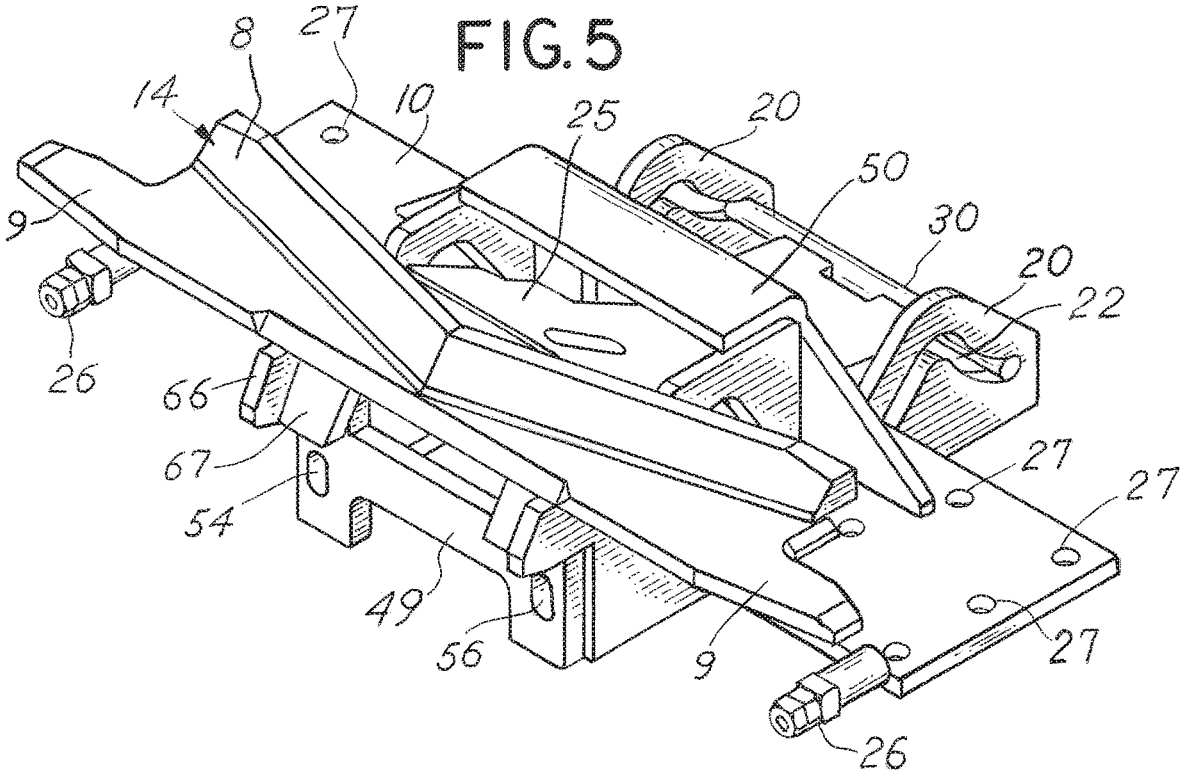
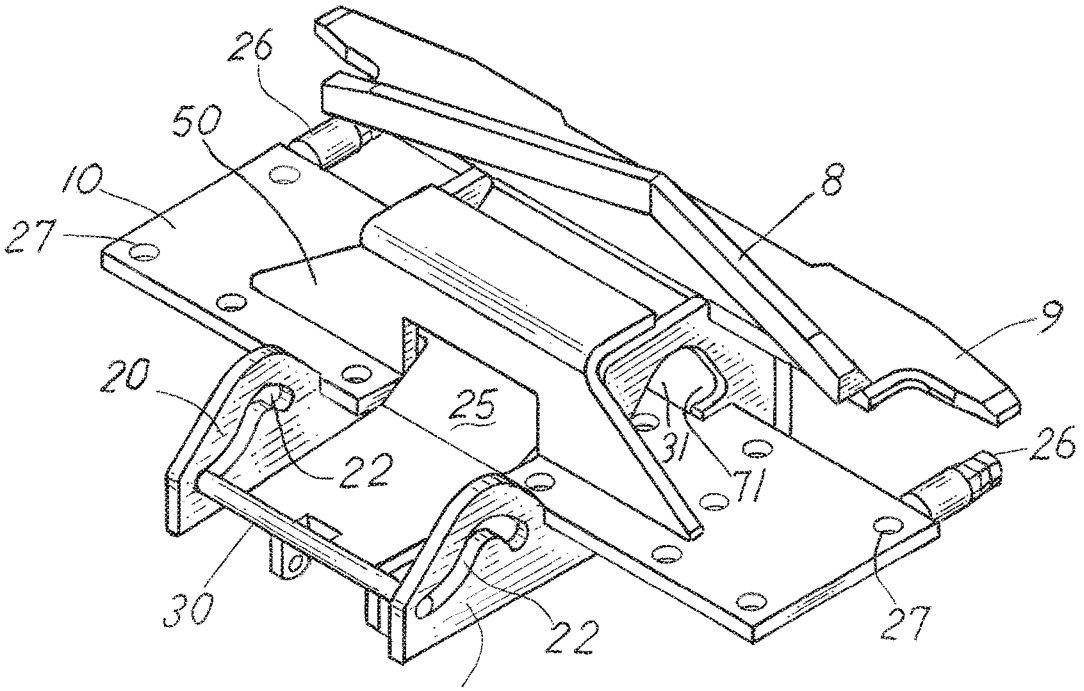
FIG.6

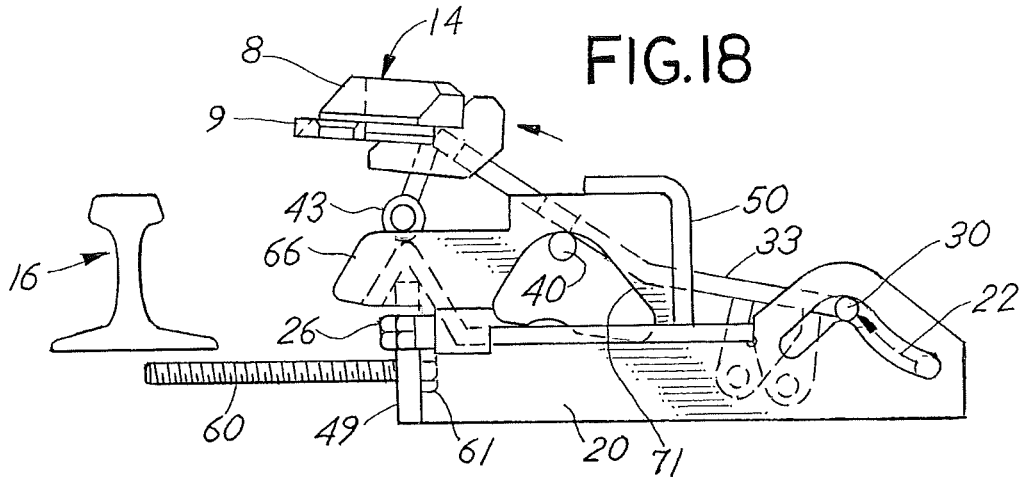
FIG.18
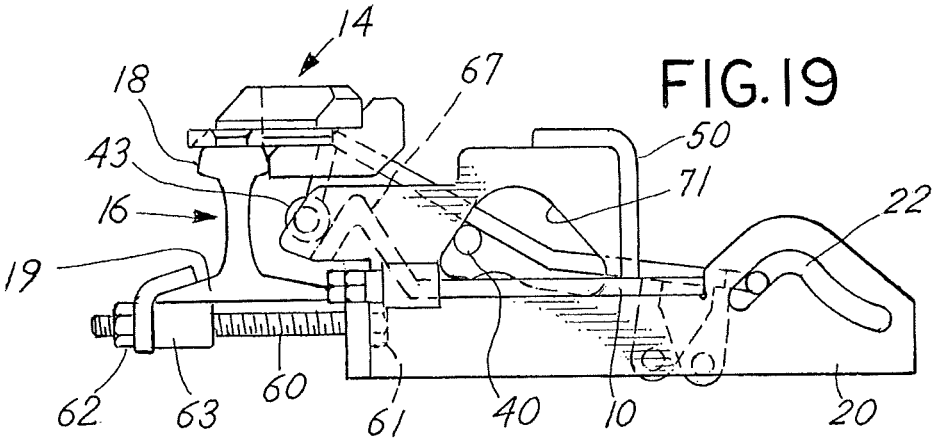
FIG.19
FIG.20
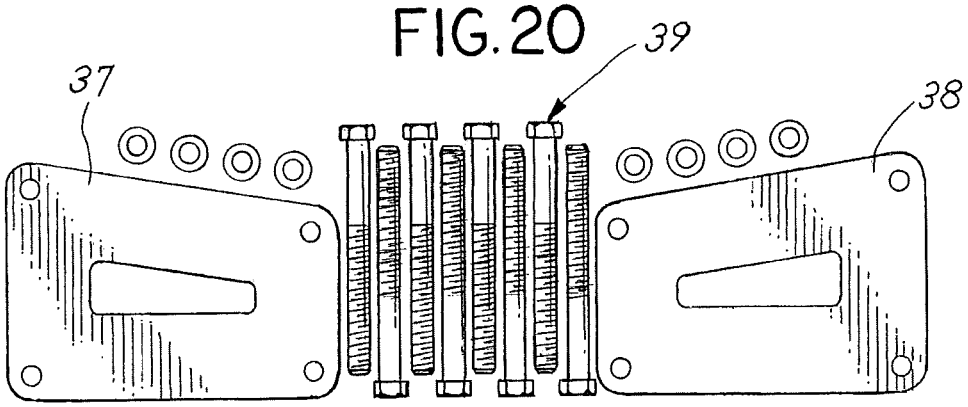

UNIVERSAL TRACK DERAILER ASSEMBLY

CROSS REFERENCE TO RELATED APPLICATION

This is a utility application claiming priority to provisional application Ser. No. 62/559,248 filed Sep. 15, 2017 entitled Universal Track Derailer Assembly.

BACKGROUND OF THE INVENTION

This invention relates to railway safety equipment, namely, a derailer assembly which is used for derailing rail vehicles including locomotives, railroad cars and the like which may be undesirably moving along railroad tracks at a relatively low speed.

There are many types of derailers or derails known in the railroad industry which have been used for many years. Certain types of derails are substantially permanently fixed to one rail of a pair of railroad track rails and various methods may be used to move the derail between an operative position and an inoperative position. Some derails are relatively light in weight and thus portable and some are heavy, bulky or otherwise not movable between operative and inoperative positions.

With the advent of railroad technology, the use of wooden ties to support steel rails has become less common. This change in technology has been inspired by the fact that wood ties may degrade over time requiring costly replacement and/or repair. Further, with the growth of rail technology, including the development of high speed rail transportation, new materials have been utilized and adapted for use as rail ties. For example, concrete and steel ties are now often utilized for the construction of railroad track systems.

Nonetheless, the necessity to provide a system for derailing rail cars has remained. Adapting derailing devices or derailers for use in combination with rails mounted on, or supported by concrete, steel and/or wood ties are thus an increasingly desired apparatus.

Heretofore, such an issue has not necessarily been addressed with respect as exemplified by various prior art patents such as the following:

| PAT. NO. | ISSUE DATE | TITLE |
|---|---|---|
| 6,105,906 | Aug. 22, 2000 | Lightweight and Ultra-Lightweight Portable Derails |
| 7,549,611 | Jun. 23, 2009 | Hinged Derail with Assisted Manual Lifting and Method for Constructing |
| 7,909,293 | Mar. 22, 2011 | Low Profile Derail |
| 8,262,033 | Sep. 11, 2012 | Derail Assembly |

Thus, there has developed over time a need for a more universal derailer system.

SUMMARY OF THE INVENTION

Briefly, the present invention comprises a derailer system and assembly which has universal application for use in combination with a rail track system employing various types of ties including wooden ties, concrete ties and steel ties. Thus, an object of the invention is to provide a single derailer device or assembly that has universal application with respect to multiple types of rail track constructions.

Further, the derailer assembly employs a design feature which may be used with multiple rail designs. That is, rails typically have a similar cross sectional design or configuration. However, the dimensions of rails are not necessarily identical or standardized, though they typically have a horizontal base flange with a medial vertical riser intermediate the lateral edges of the flange and a bulbous head supported or positioned medially on the riser.

Consequently, known derailer assembles may not function appropriately in combination with many rail designs. The referenced prior art, therefore, is not universally functional.

Additionally, another problem has developed because of the variety of rail ties that are becoming more popular. That is, the well-known wooden ties are slowly being replaced by concrete or steel ties. Placement and mounting rails on wood ties typically involves use of spikes driven into the wood ties to fasten a base flange of the rail to the ties. Such technology utilizing spikes is not practical for attachment of rails to steel or concrete ties. Thus, the use of spikes to position and attach a derailer to steel or concrete ties may not be practical.

Thus, it is an object of the invention to provide a derailer assembly that may be easily mounted on wood, concrete and steel ties.

A further object is to provide a derailer assembly that may be utilized on multiple rail designs that is having distinct and different cross sectional profiles.

These and other objects are set forth in the descriptions which follow.

BRIEF DESCRIPTION OF THE DRAWING

In the detailed description which follows, reference will be made to the drawing comprised of the following figures:

FIG. 1 is a cross section view or profile of a typical rail;

FIG. 2 is a cross sectional view or profile of an alternate rail;

FIG. 3 is a perspective view of an embodiment of the derailer assembly of the invention positioned prior to engagement with and placement on a rail set on wood ties;

FIG. 5 is a perspective view of the embodiment of FIG. 3 prior to installation on ties as viewed toward the derailer guide plate located on a guide support that is designed to fit on the top of a rail;

FIG. 6 is a perspective view of the embodiment as depicted in FIG. 5, viewed from the opposite or back side of the derailer assembly;

FIG. 18 is a side elevation view of the combination of the box assembly of FIGS. 10-13 and the arm of FIGS. 14-17 wherein the derailer shoe is elevated above the top elevation of a rail;

FIG. 19 is a side elevation of the combination of the box assembly of FIGS. 10-13 and the arm of FIGS. 14-17 depicting the shoe of the arm positioned on the top of a rail as a result of repositioning the arm assembly relative to the box assembly thereby lowering the arm depicted in FIG. 18 to position the shoe on the top of a rail;

FIG. 20 is a plan view of the contents of a kit of plates, nuts and bolts which are used in combination with the tie mounting plate of the box assembly of the derailer assembly to attach the mounting plate and thus the derailer assembly to spaced ties depicted, for example, in FIG. 4.

DESCRIPTION OF EMBODIMENTS OF THE INVENTION

Figure 4:
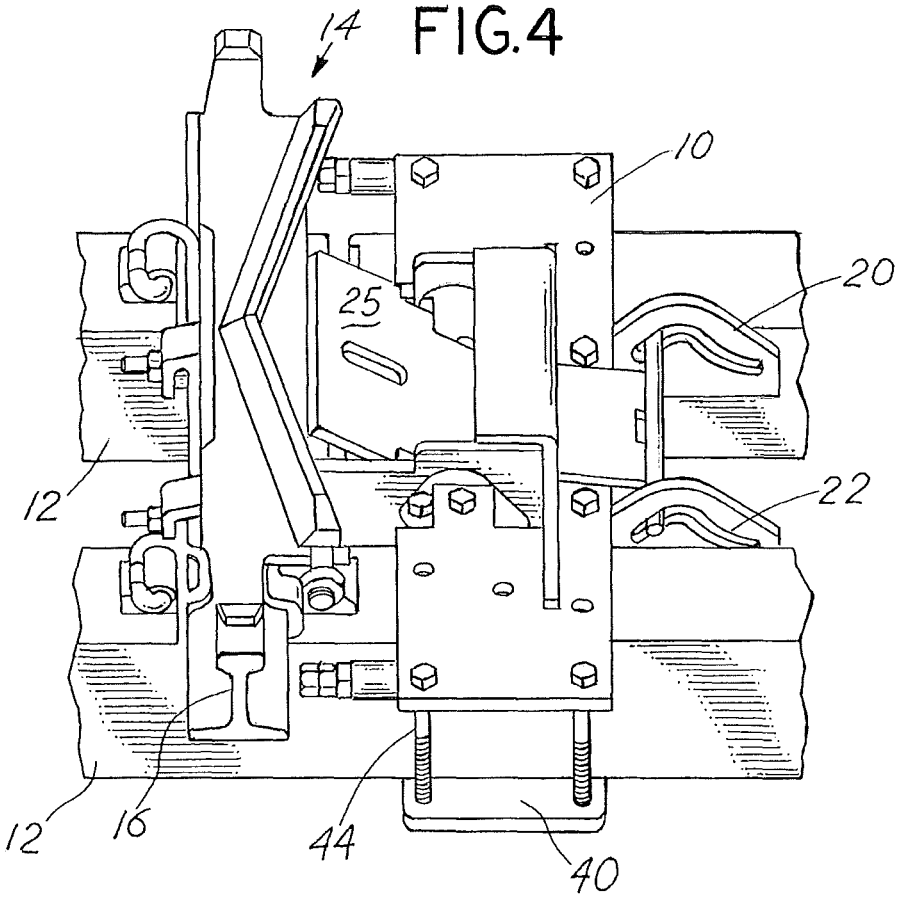
FIG. 4 is perspective view of the embodiment of the derailer assembly of FIG. 3 positioned on the top of a rail in a manner which would derail a wheel from the rail.
Figure 7:
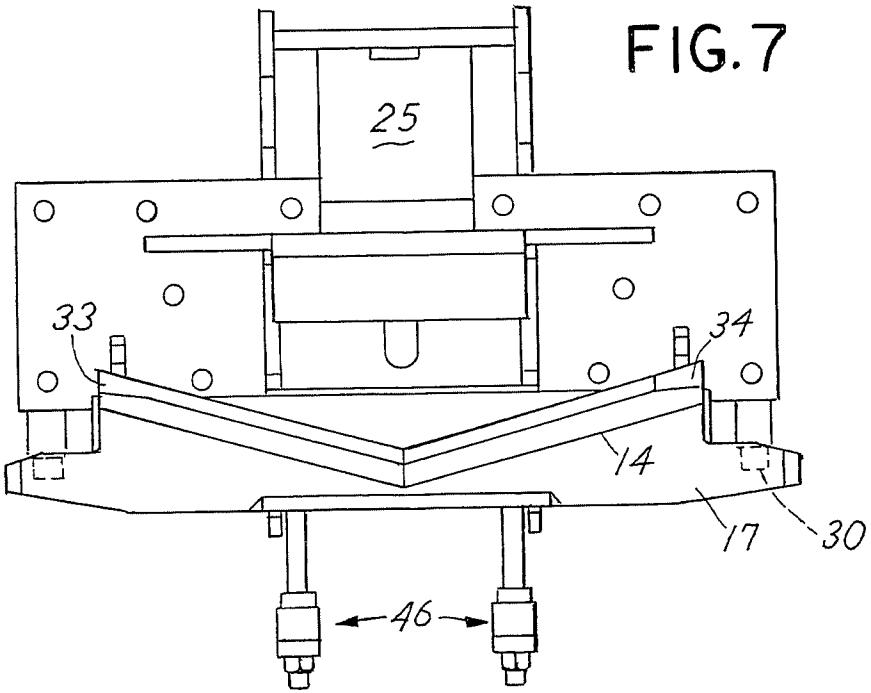
FIG. 7 is a top plan view derailer assembly of FIG. 3.
Figure 8:
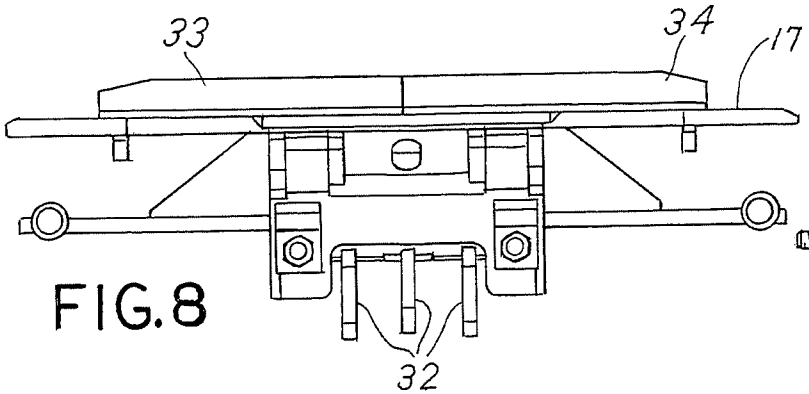
FIG. 8 is a front or forward side elevation view of the derailer of FIG. 7.

An object of the invention is to provide a universal derailer assembly which can be utilized with rails mounted on ties made of various materials and wherein the rails may vary in configuration and, more critically, in dimension. Thus, as background, FIGS. 1 and 2 illustrate cross-sectional views of typical distinct design rails 16A and 16B (generally "16") having distinct dimensional characteristics. The rails 16 are typically mounted on compatible rail attachment or hold down plates 17, or rail flanges 19 which are, in turn, fastened by spikes 13 on cross ties 12 placed on a bed. The rails 16 typically have a generally similar cross sectional profile including a flange 19, a vertical riser 24 extending vertically from the middle of the rail base flange 19 and a rail head 18 mounted on the riser 24. The rails 16 typically are symmetrical with respect to a vertical, longitudinal medial plane of the riser 24.

The subject matter of the invention is a derailer system, method and device which enables installation and positioning of the derailer assembly upon variously sized rails (FIGS. 1-2) mounted on various types of cross ties. The derailer assembly includes a construction depicted in FIGS. 3-9. The derailer assembly is designed to be attached to a flange 19 on the gage side of a rail to derail a wheel to the field side.

FIGS. 10-13 illustrate a first, of two principal components, of the derailer assembly; namely, a box assembly 15. FIGS. 14-17 depict a second of the two components of the derailer assembly; namely, a slidable arm 25 component.

Figure 9:
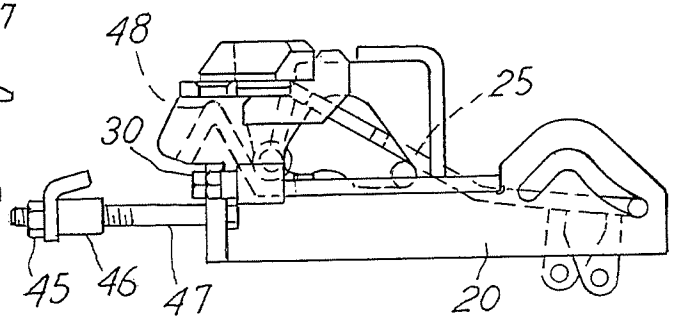
FIG. 9 is a side elevation of the derailer of FIG. 7 as viewed from the right hand side of FIG. 8.

FIGS. 9, 18 and 19 depict side elevation views of the derailer assembly and a slide sequence of the arm 25 relative to the box assembly 15 in order to position the derailer in an operative position on a rail 16.

Referring, therefore, to FIGS. 10-13, the box assembly parts and components are sized and positioned to be symmetrical relative to a medial plane vertical to a flat, generally rectangular mounting plate 10. The mounting plate 10 is designed to function as a fixed support of the medially positioned box assembly 13 and arm 25 which in combination form the derailer construction. The box assembly 15 includes two vertical spaced guide plates 20 attached to the horizontal mounting plate 10 which is designed to be placed and fixed on the top surface of spaced ties 12 with the spaced, vertical plates 20 located intermediate the opposed, lateral sides 6 of the spaced ties 12.

The mounting plate 10 further includes first and second spaced position adjustment lock bolts 26 projecting from the transverse front or forward edge 5 of mounting plate 10. The adjustment lock bolts 26 are for the purpose of providing a firm, fixed, adjustable horizontal spacing of the mounting plate 10 from a rail flange 19 on the gage side of a rail 16 when the mounting plate 10 is fixed or attached to spaced ties 12.

Further, the lateral dimension or length of the mounting plate 10 is greater than the spacing of the lateral outside edges of the two spaced ties 12. The mounting plate 10 also includes numerous openings 27 for receipt of fasteners or bolts to attach the mounting plate 10 to ties 12. The openings 27 are located over the top surface of the ties 12 as well as on the lateral sides of ties 12.

Referring further to FIGS. 10-13, spaced guide lateral side parallel channel plates 20 are connected together by cross members; namely, front side cross member 49 and r ear cross member 50 are welded and mounted on horizontal mounting plate 10. The parallel spaced arm guide channel plates 20 are thus laterally, uniformly spaced in order to fit between two spaced ties 12 made of wood, steel or concrete.

Further, the upper front end of each guide plate 20 has a reduced height front section which is dimensioned to avoid interfering with a shoe 14 of arm 25 located on a rail as depicted in FIG. 19.

Further, the rear surface of vertical cross brace 49 is welded to the front side surface of two spaced, horizontal, planar channel plates 21A, 21B. The channel plates 21A, 21B each abut and are welded to adjacent vertical guide plate 20 to form a first and a second, horizontal longitudinal bolt passage. The top of each channel plates 21A, 21B are also each attached, supported and bolted, respectively, to the underside of a projecting section of mounting plate 10 which extends through an arcuate opening 71 in spaced, vertical plates 20 (see FIG. 10).

That is, because a flange 19 may have a particular lateral side to lateral side dimension, the derailer must be adjusted to properly center the derailer on the flange. In this regard, the mounting plate 10 includes laterally spaced lock bolts 26 on the forward lateral edge of mounting plate 10. These lock bolts 26 may be adjusted to position mounting plate 10 appropriately to center the box 15 and thus the derailer on a flange 19. When properly positioned, the clamp 63 may be positioned to complete locked engagement to the flange 19. In that regard, since the mounting plate 10 is bolted to ties 12, the mounting plate 10 is fixed in place by fastener screw bolts described hereinafter with respect to FIG. 20.

Figure 10:
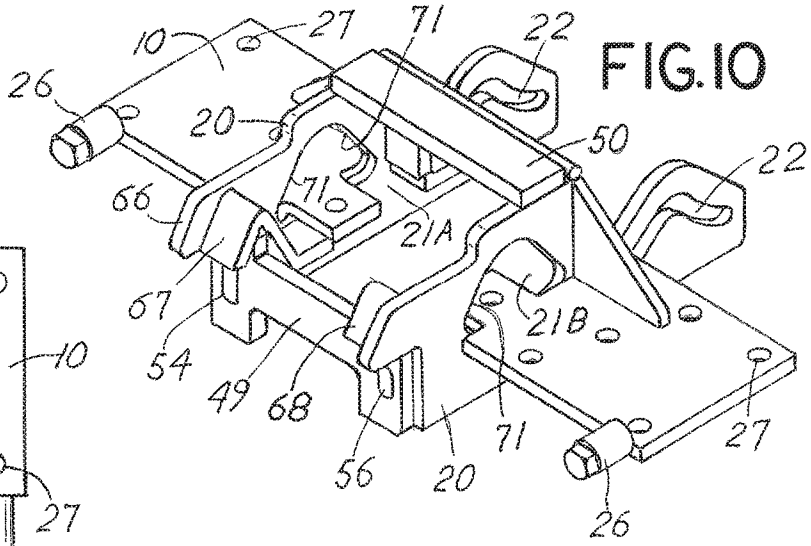
FIG. 10 is a perspective view of a box assembly component of the derailer assembly of FIGS. 3-9 and is one of two principal components of the derailer assembly.
Figure 11:
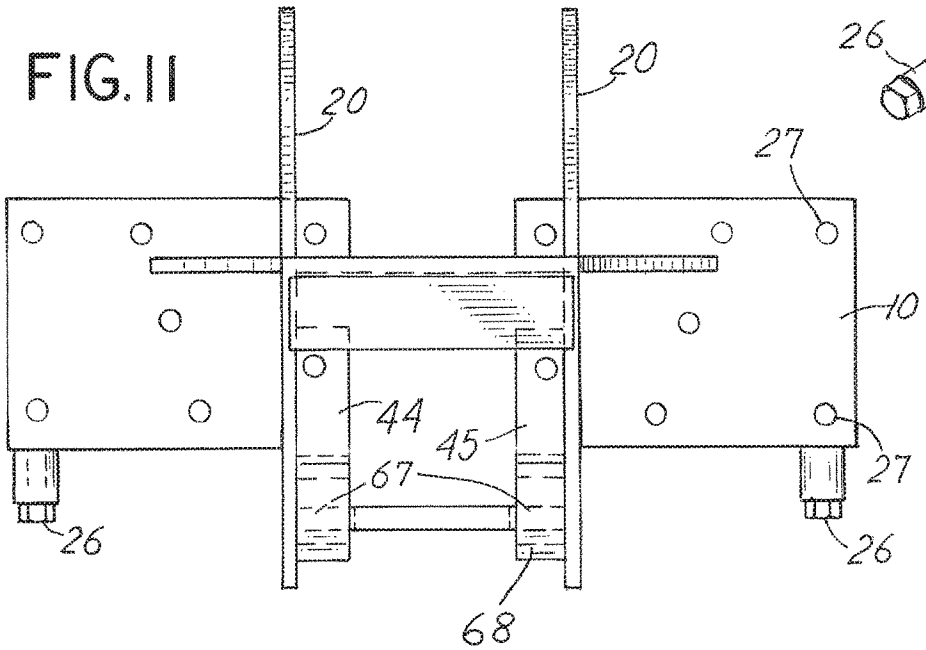
FIG. 11 is a top plan view of the box assembly of FIG. 10.
Figure 13:
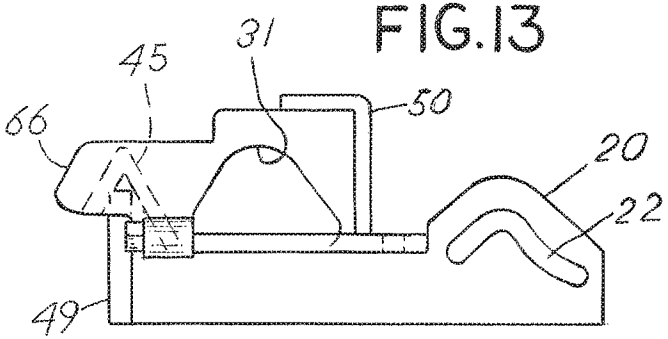
FIG. 13 is a side elevation of the box assembly of FIG. 11 as viewed toward the right side of FIG. 11.
Figure 12:
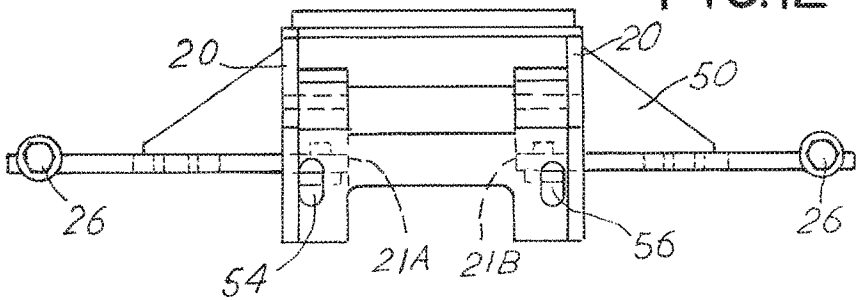
FIG. 12 is a front side elevation of the box assembly of FIG. 11.

In addition, each channel passage plate 21A, 21B includes an inverted V-shaped seat member 67, 68 mounted on the top surface thereof as illustrated in FIG. 10. Each seat member 67, 68 is welded to an opposed inside surface of the guide plates 20. Each seat member 67, 68 has a width transverse to the guide plates 20 approximately equal to the transverse width of the channel passage plates 21A, 21B. Each seat member 67, 68 includes a forwardly and upwardly pitched flat surface panel joined to a downwardly reversely pitched flat surface panel. The seat members 67, 68 have substantially identical profiles transversely viewed toward the guide plates 20 and are aligned transversely. The seat members 67, 68 are positioned at the forward end of the box assembly 15. The box assembly 15 is thus substantially symmetrical with respect to a medial vertical plane between the front and rear sides thereof.

The side wall vertical guide plates 20 of the box assembly 15 further include a generally semi-circular arc opening 71 intermediate the front and back side of each plate 20. The arc opening 71 is shaped to engage and guide followers 72 mounted on a panel 31 of arm 25. The followers 40 thus project transversely from arm 25 into the parallel arc openings 71 and engage the surface thereof as described further hereinafter to control vertical and horizontal sliding movement of arm 25.

The channel guide plates 20 also include inversely shaped V guide slots 22 at the rear or back end of box assembly 15 for receipt of a transverse pivot rod 30 affixed by welding to the back side end of a panel 31 of arm 25. Slots 22 participate in controlling horizontal sliding movement as well as vertical pitch of arm 25 and a shoe 14 attached at the front end of arm 25.

Referring therefore to the second component part of the box assembly 15, reference is directed to FIGS. 14 through 17 depicting the arm 25. The arm 25 includes shoe 14 at the outer or front end. Shoe 14 is designed to fit against the top of a rail head 18. The shoe 14 is comprised of V-shaped derailer wheel guide plate 8 and guide plate support plate 9, which is, in turn, joined to the configured panel 31 having a first section 32, joined to the shoe 14, and connected second section 33 at the terminal or rear end of the panel 31. The first section 32 and the second section 33 of the panel 31 are not coplanar but are joined by an obtuse angle bend on the top side therebetween. The second panel section 33 includes a transverse pivot rod 30 welded to the rear end of panel 31 extending transversely outwardly from opposite sides of the second panel section 33. Pivot rod 30 is designed to fit slidably into the generally inverse V-shaped slot 22 in the spaced, channel plates 20. The first panel section 32 of the panel 31 includes transverse the projecting followers 40 which fit into the arcuate opening 71 of channel plates 20 to engage and follow the arcuate surface defining the opening 71.

The width of the front end of front, first panel member section 32 is lesser than the width of the remainder an adjacent portion of section 32 of the panel 31. This enables thrust pins 43 to be positioned transversely projecting from vertical rib or side plates 44 welded to the underside of the outer transverse edges of the narrow section of panel plate section 32. The thrust pins 43 are thus positioned to engage the inverted V-shaped seats mounted on mounting panels of channel plates 21A, 21B of guide plates 20. Thus the inner end and outer end sections of plate 31 are a lesser width than the midsection of the first panel plate midsection 32 which spans the transverse space between channel plates 20. This features insures consistent, smooth and controlled movement of the pivoting arm 25 when sliding in box 15 between plates 20.

FIGS. 9, 18 and 19 illustrate in greater detail the interaction between the pivot rod 30, the rods or followers 40 and the thrust pins 43. That is, FIG. 9 depicts the position of the arm 25 including the derailer guide 8 of the shoe 14 in a position not on a rail 16. In this circumstance, the pivot rod 31 is positioned in the far-right-hand portion of the channel or slot 22 of plates 20. The rod or follower 40 laterally projecting are engaged with and positioned in contact with the arcuate channel surface 71 of the plates 20. The thrust pins 43, which are coaxially attached to downwardly-depending side plates 44, welded to the opposite sides of first panel section 32, are positioned for sliding contact with the opposed or rear side of the seat member 62.

FIG. 18 depicts forward parallel sliding movement of rod 38 of arm 25 in the slots 22, as well as followers 40 with surface 68 and pins 43 with seat 62. The shoe 14 is raised to fit over the rail 16. Thus, where the shoe 14 is in a substantially horizontal position as in FIG. 9, it is raised and pitched upwardly when moved to the position of FIG. 18 wherein the rod 38, followers 40 and pins 38 are at or near the zenith of slot 22, are 71 and seat respectively.

The interacting pair of component guide elements (i) slot 22 and rod 38, (ii) followers 40 and arcuate surface 31, (iii) pins and seats, thus are constructed, configured and designed to move in unison to control vertical elevation and pitch of the arm 25. Additionally, the design of the panel 31 of the arm enable the assembly of the derailer by enabling assembly of the box 13 and arm 25. That is, the arm without welding of the rod 38 to the outer end of the second section 33 of panel 31 enables placement of the arm panel between plates 20 by inserting the arm at an angle between the plates 20. The arm 25 may then be properly oriented in the box 15. The pivot rod may then be welded to the rear end of the panel 30 upon placement in slot 22.

To position the shoe 14 on the rail 16, the arm assembly 25 is engaged and pushed slidably to the left from the position of FIG. 18 to the position in FIG. 19. The transition between the arrangement of FIGS. 18 and 19 causes the shoe 14 to move vertically downwardly from an elevated position as the pivot rod 38 moves downwardly in the channel 22 and followers 40 and pins 43 are guided downward. The engagement and moving of the arm component 25 to the left as depicted in FIG. 19 position locks the arm 25 and shoe 14 in contact with a rail 16 as depicted. Thrust pins 43 may engage a forward retention surface on the vertical depending plate 44 to maintain the shoe 14 in the position of FIG. 19. Thus, as depicted in the sequence of FIGS. 9, 18 and 19 pivot members 68 and followers 40 and pins 43 slide respectively in the guide channel slot 22 and arc 71 and seat causing the arm 25 to pivot and also follow the contour of the semi-circular arcuate path surface 71 and seat. Thrust pins 43 thus move upwardly from a zenith and downwardly so that the thrust pins become seated and simultaneously fixed in position. The shoe 14 is thus placed horizontally on the top of the rail 16 to effect a derailer operation.

Figure 14:
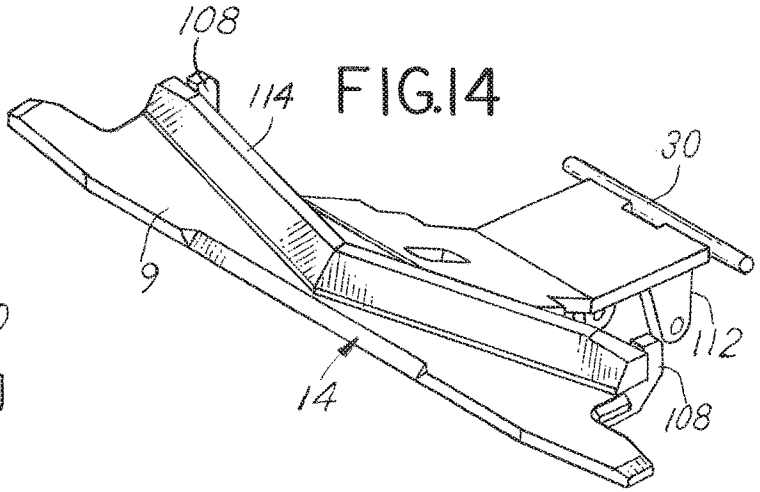
FIG. 14 is a perspective view of an arm having a derailer shoe along a front side pivot and slide plate connection member which couples the arm to the separate box assembly of FIGS. 10-13.
Figure 17:
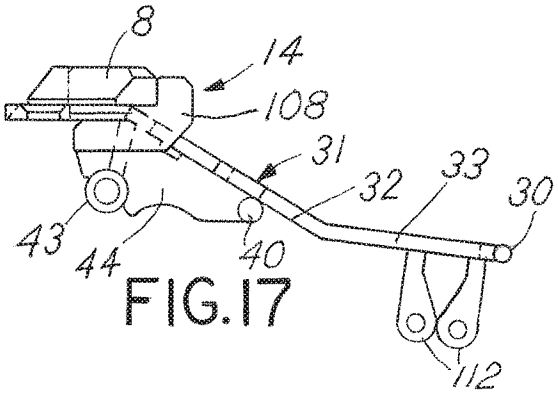
FIG. 17 is a side elevation of FIG. 16 as viewed from the right hand side of FIG. 16.
Figure 15:
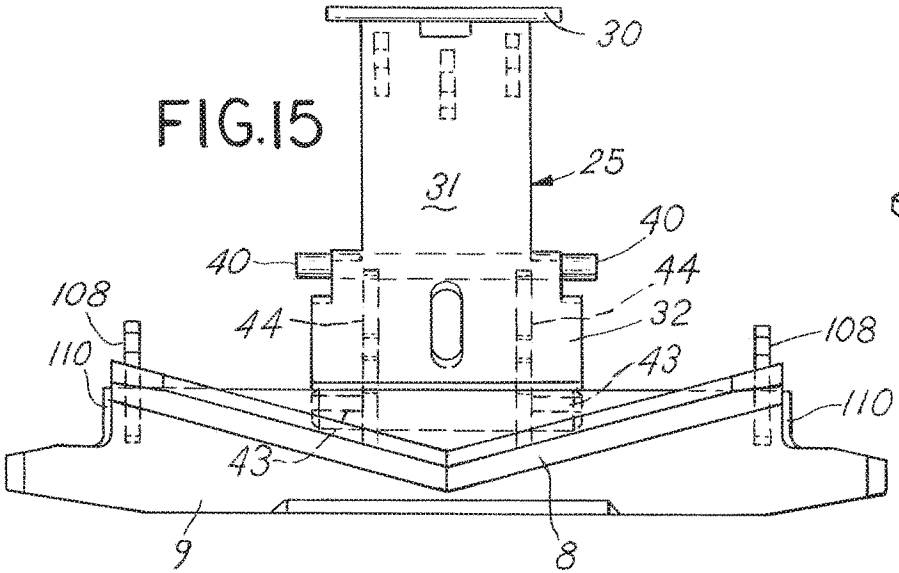
FIG. 15 is a top plan view of the arm of FIG. 14.
Figure 16:
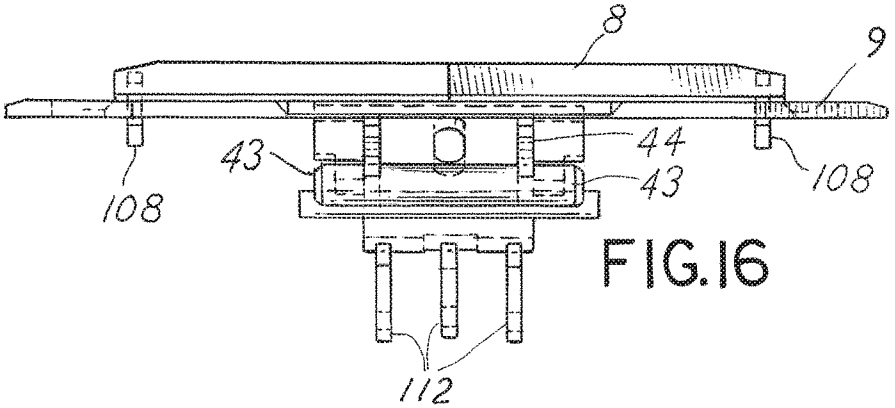
FIG. 16 is a front side elevation view of the arm of FIG. 15.

The arm 25 includes various additional features. Referring to FIG. 14, the guide plate 8 is reinforced by a flange or brace 114 positioned on the back side thereof. A flange chamfer 110 is located on the opposite ends of the guide support plate 9 (see FIG. 16). Connecting links 112 are attached to the underside of the panel 31 at the rear end of the panel 30 for attachment of connection to a drive member (not shown) that effect sliding movement of the arm 25.

Following is a summary of sequence of steps to operate the derailer of the embodiment of the invention:

Step 1—To install derailer, place mounting plate 10 on the spaced ties 12 at the gage side of rail 16 as depicted in FIG. 9. Two 12" bolts are installed prior to Step 2.

Step 2—Slide derail shoe 14 on top of rail 16 (on-rail position) and slide derail until items 44 and 108 are tight against raid head. Then slide box assembly 15 toward rail until seat 67 and thrust pin 43 make contact.

Step 3—Adjust rail base bolts 26 against gage side rail base flange 19 and tighten associated jam nut to clamp box assembly 15 against rail flange.

Step 4—Slide clamps on field side against rail flange 19 and tighten hex nut 62 on the end of the 12" bolt 59.

Step 5—For mounting on wood ties, fasten mounting plate 10 to ties 12 with six screw spikes.

Alternate Step 5—When mounting on steel or concrete ties, use a clamp kit depicted in FIG. 20. Clamp derailer to ties 12 using two mounting plates positioned underneath on the bottom surface of spaced ties and attach mounting bolts as described.

That is, utilizing spikes with a derailer may not be acceptable for attaching a plate 10 to a steel tie or a concrete tie due to the time, effort and potential damage with respect to the tie. That is, drilling passages in concrete or steel ties may be too costly and would adversely affect the structural integrity of the tie.

Thus, the assembly of the present invention further includes a kit depicted in FIG. 20 in combination with the derail assembly embodiment disclosed herein. The kit includes a pair of plates 37 and 38 in combination with an appropriate number of bolts 39 as discussed in steps outlined herein. Specifically, the plates 37 and 38 are positioned underneath ties and attached to the universal mounting plate 10 by bolts 39. The rail bed for the ties is thus temporarily partially excavated. The derailer device is then positioned on the rail 16 in the same manner used with respect to wood ties. Thus, the kit depicted in FIG. 20 enables utilization of the derailer with wood ties, concrete ties, steel ties or ties made from other materials.

While an embodiment of the invention has been described, the invention is limited only by the following claims and equivalents.

What is claimed is:

1. A derail assembly for derailing a wheel of a railway vehicle movable along a rail, said rail having a substantially straight linear axis, a field side and a gage side, wherein said rail is securely and transversely mounted on a top of said ties, said ties each having a top upright side and bottom side, said rail having an upper head and a lower flange interconnected by a central upright, unitary riser, said derail assembly comprising, in combination:

(a) a box assembly comprised of a generally horizontal, planar, mounting plate dimensioned to be positioned on and attached on the upright top side of two spaced ties, said mounting plate including first and second vertical parallel, laterally spaced guide plates spaced no greater than the spaced ties, said guide plates including in combination a pivot hinge connection element, said hinge element including pivot slots with a pivot axis generally parallel to said linear axis of a said rail;

(b) an elongate shoe including rigid derail plate having an upper side and an underside, said under side capable of being in contact on a said rail head of a said rail, said elongated rigid derail plate further having a wheel entrance end and a wheel exit end being longitudinally spaced from said wheel entrance end, said derail plate further including an attached transversely projecting pivot panel arm with a pivot axis parallel to the box assembly pivot axis slots of the guide plates, said pivot axis of said projecting arm and said pivot axis of said slots of said guide plates are generally parallel, coextensive and simultaneously adjustable upon pivoting of the pivoting arm of said shoe positioned in the slots between the parallel guide plates of the box assembly; and (c) fasteners for attaching the mounting plate to ties.

2. The assembly of claim 1 further including a kit for attachment of the mounting plate to a tie, said kit including at least one supplemental plate for position against an underside of each of said ties and fasteners for connecting the supplemental plate to the mounting plate on said top side.

3. The assembly of claim 1 further including a seat member on said box assembly intermediate the front of said box assembly and the slot pivot axis and further including a thrust member projecting parallel to the pivot axis of said slot from one of said vertical guide plates and positioned to engage a surface of a seat member mounted on said box assembly.

4. A derail assembly for derailing a wheel of a railway vehicle movable along a rail, said rail having a substantially straight linear axis, a field side and a gage side, wherein said rail is securely and transversely mounted on a top of said ties, said ties each having a top upright side and bottom side, said rail having an upper head and a lower flange interconnected by a central upright, unitary riser, said derail assembly comprising, in combination:

(a) a box assembly, said box assembly including:

(i) a mounting plate dimensioned to be positioned on and attached onto the upright top side of two spaced ties, said mounting plate comprising a planar plate generally horizontal member having a lateral dimension greater than the spacing of said spaced ties, (ii) first and second laterally spaced, vertical guide plates mounted on said mounting plate intermediate lateral sides of said mounting plate for positioning to a gage side of a rail, said laterally spaced, vertical guide plates positioned no greater than spacing the ties, said first and second guide plates having a substantially identical profile and including one or more follower openings through the guide plates;

(b) an elongate separate shoe including a rigid derail plate, an upper side and an underside, said upper side positioned for and capable of contact with a said rail gage side;

said elongated rigid derailer plate further including a rail wheel entrance end and a wheel exit end;

said elongated shoe further including an attached, transversely projecting pivot panel arm, said arm including axially, transversely projecting pivot members for engagement with and following follower openings of said first and second guide plates to engage or disengage the derailer plate upon movement of the arm transversely toward or from the gage side of the said rail; and (c) fasteners for attaching the mounting plate on spaced ties.

5. The assembly of claim 4 further including a seat member on said box assembly intermediate the front of said box assembly and further including a thrust member projecting parallel to the pivot axis from one of said vertical guide plates and positioned to engage a surface of a seat member mounted on said mounting plate.

6. The assembly of claim 4, wherein in said derailer plate comprises a underside section configured to be positioned in contact with a riser and underside of a said rail and the upper side is positioned to engage the head of a said rail.

* * * * *